US005532455A

United States Patent [19]

Bouleau et al.

[11] Patent Number: 5,532,455

[45] Date of Patent: Jul. 2, 1996

[54] SOLE FOR AN ELECTRIC STEAM IRON WITH ALTERNATING VAPORIZATION AND HEATING REGIONS

[75] Inventors: Jean-Paul A. A. Bouleau, Champfleur; Gerard L. H. Guillot, Radon, both of France

[73] Assignee: Moulinex (Societe Anonyme), Bagnolet, France

[21] Appl. No.: 516,253

[22] Filed: Aug. 17, 1995

Related U.S. Application Data

[63] Continuation of Ser. No. 231,302, Apr. 22, 1994, abandoned.

[30] Foreign Application Priority Data

Apr. 23, 1993 [FR] France ..... 93 04850

[51] Int. Cl.[6] ..... D06F 75/38

[52] U.S. Cl. ..... 219/245; 38/77.1

[58] Field of Search ..... 219/245, 246, 219/249, 254, 255, 258; 392/399, 403–406; 38/77.1–77.9

[56] References Cited

U.S. PATENT DOCUMENTS

| | | | |
|---|---|---|---|
| 1,347,224 | 7/1920 | Kako | 38/77.2 |
| 1,494,113 | 5/1924 | Hoffman | 38/77.6 |
| 2,317,261 | 4/1943 | Dowinsky | 38/77.6 |
| 4,665,637 | 5/1987 | Kramer | 219/245 |
| 4,854,059 | 8/1989 | Ronchi | 38/77.8 |
| 5,115,117 | 5/1992 | Amiot et al. | 219/254 |

FOREIGN PATENT DOCUMENTS

| | | | |
|---|---|---|---|
| 358310 | 3/1990 | European Pat. Off. | 38/77.1 |
| 377803 | 7/1990 | European Pat. Off. | 38/77.83 |
| 225149 | 7/1985 | Germany | 38/77.1 |
| 4107236 | 9/1992 | Germany | 38/77.9 |

*Primary Examiner*—John A. Jeffery
*Attorney, Agent, or Firm*—Young & Thompson

[57] ABSTRACT

A sole for an electric steam iron, which comprises, on its lower surface (9), from the point (3) toward the heel (20), after a first steaming region (14), a first drying region (16), free from steam outlet openings, and extending transversely between the lateral edges (30 and 40) of the sole (1). This first drying region (16) is followed by a second steaming region (17) extending transversely between the lateral edges (30 and 40) of the sole (1) and into which open steam outlet openings (10). The second steaming region (17) is in turn followed by a second drying region (18) free from steam outlet openings, that extends over all the remaining rear surface of the sole.

6 Claims, 2 Drawing Sheets

SOLE FOR AN ELECTRIC STEAM IRON WITH ALTERNATING VAPORIZATION AND HEATING REGIONS

This application is a continuation of application Ser. No. 08/231,302, filed Apr. 22, 1994, now abandoned.

FIELD OF THE INVENTION

The invention relates to an electric steam iron comprising a sole extending longitudinally from a point near a heel, and comprising a heating element molded in a projection and two vaporization chambers closed by a cover and separated by a partition, namely a first principal vaporization chamber supplied with water through a first device for the injection of water through a first opening provided in the cover and communicating with outlet openings for steam provided in the sole adjacent to lateral edges of said sole, and a second vaporization chamber disposed in the forward region of the sole, supplied with water by means of a second water injection device through a second opening provided in the cover and communicating with other outlet openings for steam provided in the central forward portion of the sole, the openings provided adjacent the lateral edges of the sole and the openings provided in the central forward portion of the sole forming on said sole a first vaporization region.

BACKGROUND OF THE INVENTION

Known types of soles for electric steam irons made for example of aluminum ordinarily comprise numerous transverse steam outlet openings to distribute the steam over all the surface of the sole. The transverse openings are distributed over a large portion of the surface of the sole to ensure good moistening of the cloth. However, numerous transverse openings ordinarily give rise to too great a moistening of the cloth as well as moistening of the support on which the cloth to be ironed rests such as an ironing board.

OBJECT OF THE INVENTION

The object of the invention is to overcome the present drawbacks by providing an electric steam iron whose sole improves the distribution of the steam while improving the quality of ironing.

SUMMARY OF THE INVENTION

According to the invention, the sole of the electric steam iron comprises moreover on its lower surface, from the point toward the heel, after the first vaporization area, a first drying area, free from steam outlet openings, and extending transversely between the lateral edges of the sole, this so-called first drying region being followed by a second vaporization region extending transversely between the lateral edges of the sole and into which open the steam outlet openings, said second vaporization region being itself followed by a second drying region free from steam outlet orifices and extending over all the remaining rear surface of the sole.

Thanks to the distribution of the different drying and vaporization areas over the sole of the electric steam iron, the cloth to be pressed is subjected to a double action ensuring flattening of the cloth. Thus, during ironing, the cloth is stretched out, then steamed, then dried, and then again steamed and dried. On the other hand, the distribution of the steam below the sole, by means of the channels, avoids too great ejection of water outwardly, thus minimizing the too great moistening of the cloth and/or of the ironing support. Finally, the successive distribution of the regions of drying and steaming extending transversely between the lateral edges of the sole facilitates ironing of the cloth upon back and forth movement of the iron on the cloth.

BRIEF DESCRIPTION OF THE DRAWINGS

The characteristics and advantages of the invention will become further apparent from the description which follows, given by way of nonlimiting example, with reference to the accompanying drawings, in which.

DETAILED DESCRIPTION OF THE PRIOR ART

Figure 1:
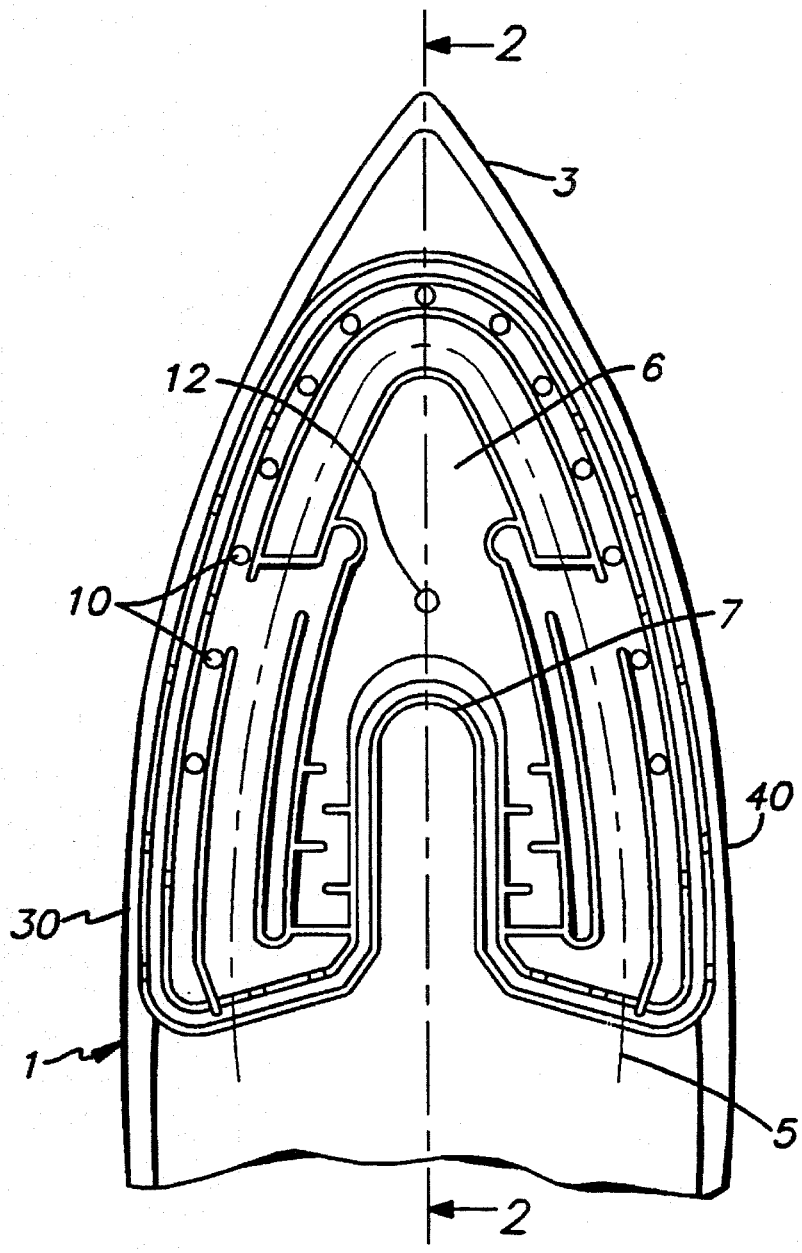
FIG. 1 PRIOR ART
FIG. 1 is a fragmentary view from above of a sole of an electric iron with a cover removed closing the steam chambers and existing in the prior art.
Figure 2:
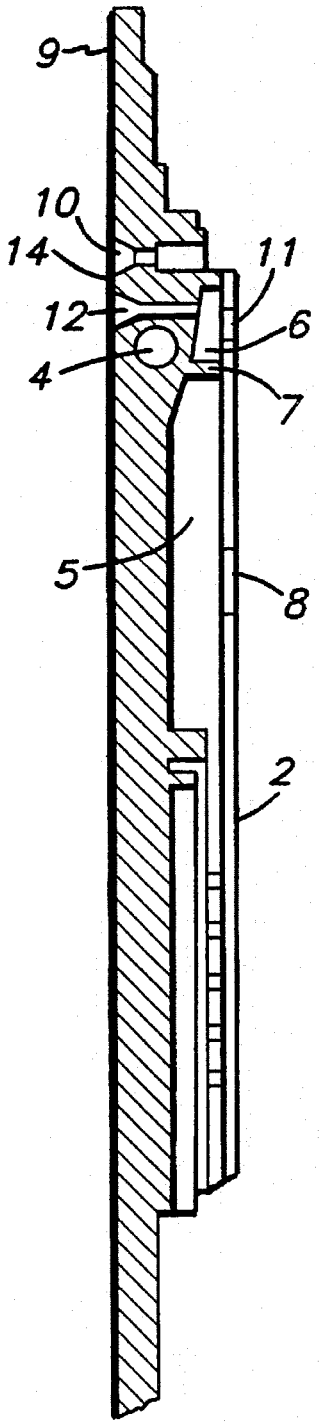
FIG. 2 PRIOR ART
FIG. 2 is a cross-section on long line 2—2 of FIG. 1, in which the steam chambers are covered by the cover.

In FIGS. 1 and 2, an electric steam iron of known type comprises a sole 1, for example of aluminum, extending longitudinally from a point 3 toward a heel not shown on FIG. 1, and comprising heating element 4 molded into a projection and two chambers 5 and 6 closed by a cover 2 and separated by a partition 7.

The first vaporization chamber 5 is supplied with water by means of a first water injection device (not shown) which passes through a first opening 8 provided in the cover 2. The first vaporization chamber 5 communicates with outlet openings 10 for steam provided in the lower face 9 of the sole adjacent to lateral edges 30 and 40 of said sole 1. The second vaporization chamber 6 is disposed in the forward region of the sole 1. It is supplied with water by means of a second water injection device (not shown) which passes through a second opening 11 provided in the cover 2. Said second vaporization chamber 6 communicates with other outlet openings 12 for steam provided in the forward central portion of the sole 1. The openings 10 provided adjacent to the lateral edges of the sole 1 and the openings 12 provided in the forward central portion of the sole 1 form, on said lower surface 9 of the sole 1, a first vaporization region 14.

DETAILED DESCRIPTION OF THE INVENTION

Figure 3:
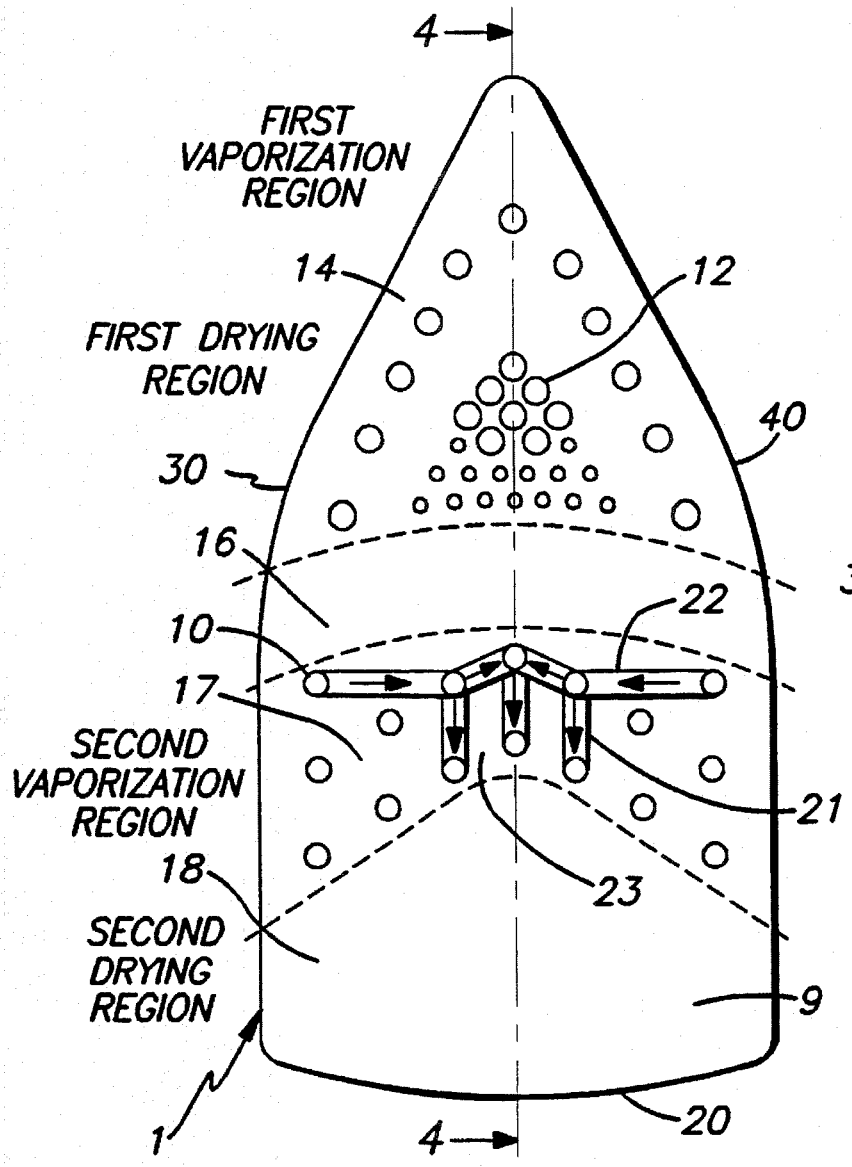
FIG. 3 is a plan view of the lower surface of the sole of an electric iron according to the invention.
Figure 4:
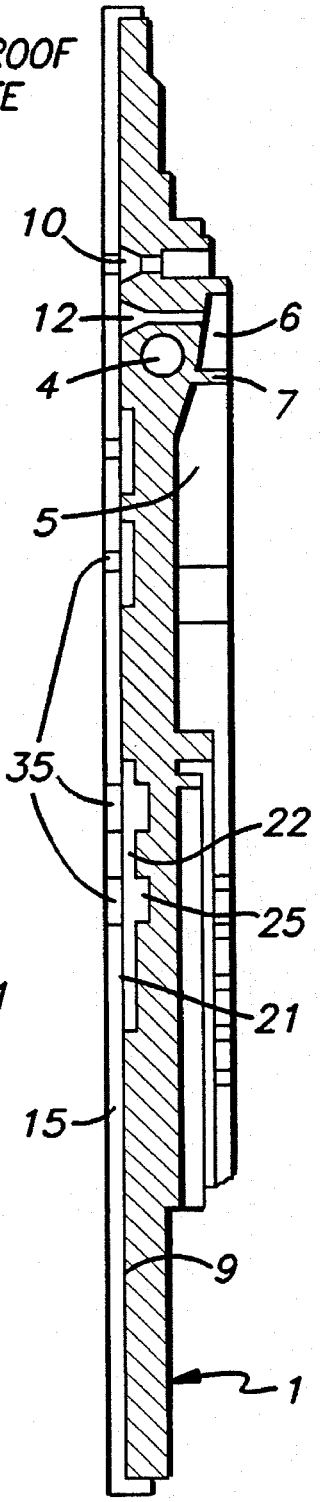
FIG. 4 is a cross-sectional view on line 4—4 of FIG. 3, and in which the sole according to the invention is covered by a perforated rustproof plate.

According to an embodiment illustrated in FIGS. 3 and 4, the sole 1 according to the invention comprises moreover on its lower surface 9, from the point 3 toward the heel 20 after the first vaporization region 14, a first drying region 16 free from steam outlet openings and extending transversely between the lateral edges 30 and 40 of the sole 1. Said first drying region 16 is followed by a second vaporization region 17 which extends transversely between the lateral edges 30 and 40 of the sole 1 and into which open the steam outlet openings 10. The second vaporization region 17 itself is followed by a second drying region 18 free from steam outlet openings and extending over all the remaining rear surface of the sole 1.

The second vaporization region 17 comprises channels for supplying steam 21 and 22 toward the central portion 23 of the sole 1. Said channels are adapted to distribute the steam issuing from the steam outlet openings 10 over all said second vaporization region 17.

In a particular embodiment shown in FIG. 4, the metal sole 1 of the steam iron is covered with a rustproof plate 15. In such a case, the steam channels are formed by channels 21 and 22 covered by the plate 15. Said plate 15 has, for this purpose, holes 35 located facing the steam outlet openings. The channels 21 and 22 comprise circular recesses having a substantially different depth for, on the one hand, directing the flow of steam, and, on the other hand, to reduce calcified deposits. The channels 21 and 22 are longitudinal channels 21 and transverse channels 22. The flow of steam issuing from the steam outlet orifices 1 thus follows the path represented by the arrows in FIG. 3. In this way, the second vaporization region provided with channels 21 and 22 has the general lateral shape of a chevron, the apex of whose V is turned toward the point 3 of the iron.

Thanks to the sole described according to the invention, the steam flow is distributed over the two vaporization regions 14 and 17 in alternation with drying regions 16 and 18, improving the quality of ironing.

What is claimed is:

1. In an electric steam iron comprising a sole (1) extending longitudinally from a point (3) toward a heel (20) of the iron, and comprising a heating element (4) and two vaporization chambers (5, 6) closed by a cover (2) separated by a partition (7), said chambers comprising a first principal vaporization chamber (5) supplied with water by means of a first water injection device through a first opening (8) provided in the cover (2) and communicating with steam outlet openings (10) provided in the sole adjacent to lateral edges (30, 40) of said sole (1), and a second vaporization chamber (6) disposed in the forward region of the sole (1), supplied with water by means of a second water injection device through a second opening (11) provided in the cover (2) and communicating with other steam outlet openings (12) provided in the forward central portion of the sole, the openings (10) provided adjacent to lateral edges of the sole and the openings (12) provided in the forward central portion of the sole forming on said sole a first steaming region (14); the improvement wherein the sole (1) further comprises on its lower surface (9), from the point (3) toward the heel (20), after the first steaming region (14), a first drying region (16), free from steam outlet openings, and extending transversely between the lateral edges (30 and 40) of the sole (1), said first drying region (16) being followed by a second steaming region (17) extending transversely between the lateral edges (30 and 40) of the sole (1) and into which open transversely spaced apart steam outlet openings (10), said first drying region being bordered forwardly by said steam outlet openings (12) of said first steaming region (14) and rearwardly by said steam outlet openings (10) of said second steaming region (17), said first drying region having an extent between said lateral edges (30 and 40) that is substantially greater than its width between said steaming regions (14 and 17) and that is substantially greater than the spacing in any direction between said steam outlet openings (12) of said first steaming region (14), said second steaming region (17) being followed by a second drying region (18) free from steam outlet openings and extending over all remaining rear surface of the sole.

2. Electric steam iron according to claim 1, wherein the second steaming region (17) comprises supply channels for steam (21, 22) toward the central portion (23) of the sole (1), said channels (21 and 22) being adapted to distribute the steam issuing from the steam outlet openings (10) over all said second region (17).

3. Electric steam iron according to claim 2, wherein the sole (1) is covered with a rustproof plate (15), and the vapor channels are formed by channels covered by the rustproof plate (15), said rustproof plate having holes located facing the steam outlet openings.

4. Electric steam iron according to claim 3, wherein the channels comprise circular recesses having substantially different depths.

5. Electric steam iron according to claim 4, wherein the channels comprising circular recesses are longitudinal and transverse channels.

6. Electric steam iron according to claim 1, wherein the second vaporization region has the shape of a chevron whose V-shaped apex is turned toward the point (3) of the iron.

* * * * *